United States Patent [19]

Senske et al.

[11] Patent Number: 4,900,646

[45] Date of Patent: Feb. 13, 1990

[54] ELECTROPHOTOGRAPHIC RECORDING MATERIAL AND METHOD OF PRODUCING IT

[75] Inventors: Wilhelm Senske, Eschborn; Ekkehard Niemann, Maintal; Roland Herkert, Frankfurt am Main; Guido Blang, Brauneberg, all of Fed. Rep. of Germany

[73] Assignee: Licentia Patent-Verwaltungs-GmbH, Frankfurt am Main, Fed. Rep. of Germany

[21] Appl. No.: 201,432

[22] Filed: May 24, 1988

[30] Foreign Application Priority Data

May 26, 1987 [DE] Fed. Rep. of Germany ..... 3717727

[51] Int. Cl.[4] ..... G03G 5/082

[52] U.S. Cl. ..... 430/64; 430/66; 430/84; 430/95; 430/128

[58] Field of Search ..... 430/64, 57, 63, 65, 430/67, 66, 84, 95, 128

[56] References Cited

U.S. PATENT DOCUMENTS 4,412,900 11/1983 Tanaka et al. ..... 437/4
4,738,913 4/1988 Shirai et al. ..... 430/65

FOREIGN PATENT DOCUMENTS 0038221 10/1981 European Pat. Off. .
0045204 2/1982 European Pat. Off. .
3117035 2/1982 Fed. Rep. of Germany .
3245500 6/1984 Fed. Rep. of Germany .

OTHER PUBLICATIONS

"Photovoltaic Properties of Amorphous Silicon Produced by Reactive Sputtering" Moustakas, Solar Energy Materials, vol. 13, pp. 373-384, 1986.
"Stability of Amorphous Silicon Photoreceptor for Diode Laser Printer Application," Nakayama et al., vols. 59 & 60, pp. 1231-1234, 1983.

*Primary Examiner*—John L. Goodrow
*Attorney, Agent, or Firm*—Spencer & Frank

[57] ABSTRACT

A method of producing an electrophotographic recording material, in which an aluminum substrate is coated with a blocking layer. The blocking layer is coated with a layer of amorphous silicon by direct current magnetron cathode sputtering. At least one sputter target containing silicon is used, and a power density of from about 2.0 $W/cm^2$ to about 30 $W/cm^2$ is used for the sputtering. The sputtering is performed in an atmosphere containing hydrogen and an inert gas, with a total pressure of inert gas and hydrogen being in a range from about $1\times10^{-3}$ to about $10\times10^{-3}$ mbar. This produces a layer of amorphous silicon having a hydrogen content of more than 40 atom %, an inert gas content in a range of 0.01 to 10 atom %, and in which the relative peak heights of the low and high temperature peaks during hydrogen effusion are approximately equal. The amorphous silicon layer is then coated with a cover layer.

17 Claims, 5 Drawing Sheets

ELECTROPHOTOGRAPHIC RECORDING MATERIAL AND METHOD OF PRODUCING IT

FIELD OF THE INVENTION

The present invention relates to a method of producing an electrophotographic recording material which includes applying a layer of amorphous silicon on a substrate using cathode sputtering.

TECHNOLOGY REVIEW

An electrophotographic layer of amorphous silicon, hereinafter called an a-Si layer, is required to have a high dark resistance greater than $10^{12}$ Ω cm, a charging field intensity greater than 40 V/μm and good chargeability.

Such layers are coated on relatively large-area copier drums which are adapted in size to accommodate standard paper sizes (DIN A4, A3).

German patent document (published without examination) No. 3,117,035 discloses the production of electrophotographic a-Si layers by means of a silane glow discharge process; in this case, a small amount of diborane and oxygen are added to the silane atmosphere. European Pat. No. 0,045,204 corresponding to U.S. Pat. No. 4,365,013 discloses the use of high frequency magnetron sputtering for the production of a-Si layers. In this process, cathode sputtering takes place in an atmosphere of argon and hydrogen and the resulting material is composed of a plurality of layers, with one of the layers having Si-O bonds.

The large-area a-Si layer applied to the copier drum should advisably have a thickness greater than or equal to 10 μm. In apparatus operating with a silane glow discharge for the application of such photoconductive layers, a deposition rate up to 10 μm/h is possible.

The Journal of Non-Crystalline Solids, Nos. 59 & 60, 1983, pages 1231–1234, discloses that a deposition rate up to 10 μm/h can be achieved by means of silane glow discharge. Silane is a spontaneously combustible gas which flows through the reactor at a high flow rate of 1000 standard cubic centimeter per minute, hereinafter sccm. To achieve good electrophotographic characteristics for the a-Si layer, the layer must additionally be doped with boron from a gas mixture of $B_2H_6+SiH_4$. Diborane is a very toxic gas.

German patent document (published without examination) No. 3,245,500 mentions the fact that an electrophotographic recording material can be produced with high growth rates by the use of magnetron cathode sputtering processes operating at high frequencies or with direct current. Tests have now shown that, with justifiable expenditures for engineering and labor, apparatus operating with high frequency magnetron sputtering produce deposition rates of only about 3 μm/h. The publication does not reveal any further details regarding direct current magnetron sputtering.

A considerable amount of time is required to produce a large-area a-Si layer having a thickness greater than 10 μm. The large amount of time involved has in the past prevented the mass production of a-Si layers for copier drums of the above-mentioned thickness by means of direct current magnetron sputtering.

SUMMARY OF THE INVENTION

It is an object of the invention to improve the method of producing an electrophotographic material in such a way that large-area a-Si layers having good electrophotographic characteristics and deposition rates of greater than 10 μm/h can be produced with significantly less expenditures of time and money.

This is accomplished by the present invention which provides a method of producing an electrophotographic recording material, in which an aluminum substrate is coated with a blocking layer. The blocking layer is coated with a layer of amorphous silicon by direct current magnetron cathode sputtering. At least one sputter target containing silicon is used, and a power density of from about 2.0 W/cm$^2$ to about 30 W/cm$^2$ is used for the sputtering. The sputtering is performed in an atmosphere containing hydrogen and an inert gas, with a total pressure of inert gas and hydrogen being in a range from about $1\times10^{-3}$ to about $10\times10^{-3}$ mbar. This produces a layer of amorphous silicon having a hydrogen content of more than 40 atom %, an inert gas content in a range from 0.01 to 10 atom %, and in which the relative peak heights of the low and high temperature peaks during hydrogen effusion are approximately equal. The amorphous silicon layer is then coated with a cover layer.

The present invention has the following advantages.

At deposition rates of about 10 μm/h, the recording material exhibits charging field intensities up to 80 V/μm; its dark resistance at room temperature is $10^{12}$ to $10^{14}$ Ω cm. The resulting layers are homogeneous and amorphous and can be charged positively as well as negatively. A material rich in voids is obtained so that the a-Si layer adheres very well to the substrate. Due to the increased deposition rate, the material can be produced more economically.

DESCRIPTION OF THE PREFERRED EMBODIMENTS

Manufacturing process:

Photoconductive layers of a structure of $Al/SiO_x/a$-Si are produced on Al substrates; the $SiO_x$ forms a blocking layer.

The a-Si layer was produced under the following conditions:

| | |
|---|---|
| total pressure of argon + hydrogen | $5 \times 10^{-3}$ mbar |
| hydrogen percentage in the cathode sputtering atmosphere | 40.7% |
| substrate temperature | 150° C. |
| argon gas influx | 14 |
| target: crystalline Si, n-type | 1 Ω cm |

To avoid difficulties during the direct current discharge, the resistance of the target is advisably selected to be less than or equal to 10 Ω cm.

Under these conditions, deposition rates greater than 10 μm/h were obtained with acceptable electrophotographic data.

The a-Si layers produced according to the method of the invention may have an oxygen and carbon content of 0 to 10 atom % each; this results in greater photoconductivity and chargeability of the layers.

The material produced according to the invention and the material produced by means of high frequency magnetron cathode sputtering were subjected to hydrogen effusion measurements for the purpose of examining their structure and determining the hydrogen content in the a-Si layers.

Figure 1:
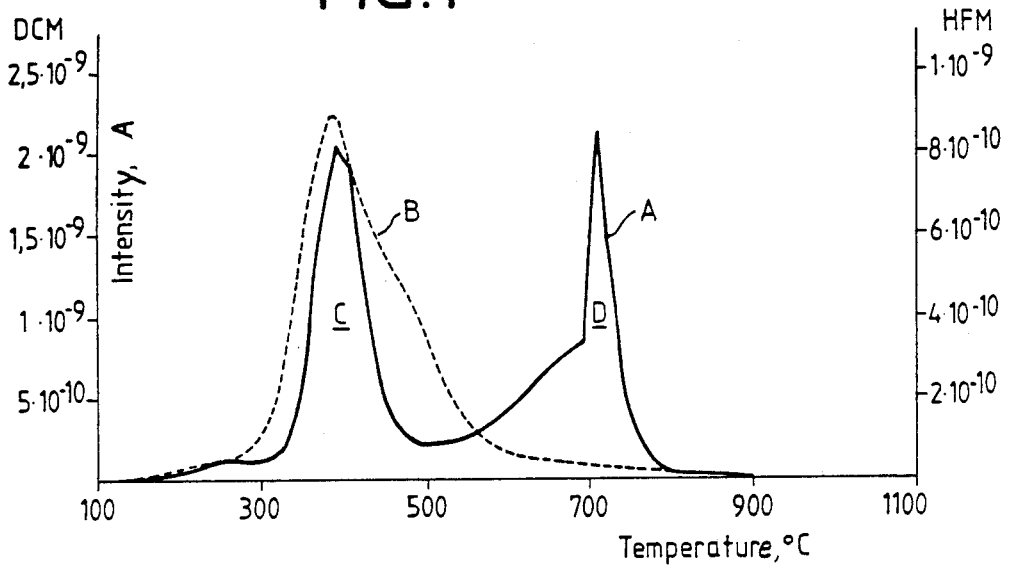
FIG. 1 shows the hydrogen effusion curves of an a-Si layer produced by means of the method according to the invention and of an a-Si layer produced by means of high frequency magnetron cathode sputtering.

In the diagram of FIG. 1, the hydrogen effusion curve A relates to an a-Si layer produced according to the method of the invention while curve B relates to an a-Si layer produced by means of high frequency magnetron sputtering. The ordinate marked DCM applies to curve A and the ordinate marked HFM applies to curve B; the temperature of the sample is plotted on the abscissa.

Curve A indicates a hydrogen content of 41.4 atom % for the a-Si layer produced by means of direct current magnetron cathode sputtering and curve B indicates a hydrogen content of 19.2 atom % for the a-Si layer produced by means of high frequency magnetron cathode sputtering.

The a-Si produced by direct current magnetron cathode sputtering contains inert gas from the plasma produced during cathode sputtering in an amount from 0.01 to 10 atom %, and is preferably 0.01 to 0.1 atom % of argon. As can be seen from the shape of curve A, the hydrogen in the a-Si layer produced according to the method of the invention effuses at temperatures around 400° C. (low temperature peak C) and around 700° C. (crystallization peak D). The low temperature peak C indicates that the material is rich in voids. The hydrogen discharged at about 400° C. is present in the voids within the a-Si layer and contributes to the saturation of the inner surfaces of the layer. This saturation results in the good electronic and optical characteristics of the amorphous silicon. Particularly for relatively thick a-Si layers (>10 μm), material rich in voids is preferred because it is more elastic and adheres better to the substrate. The crystallization peak D around 700° C. indicates the percentage of bound hydrogen in the a-Si layer; a high percentage of bound hydrogen is significant for achieving good electrophotographic characteristics in the material.

To realize an a-Si layer produced by means of direct current magnetron sputtering with good electrophotographic characteristics, the relative heights of peaks C and D must be approximately the same. The hydrogen percentages that can be derived from peaks C and D indicate a high total hydrogen content greater than 40 atom % in the a-Si layer.

As can be seen from the shape of curve B, in an a-Si layer produced by means of high frequency magnetron cathode sputtering, the hydrogen effuses essentially around 400° C. (low temperature peak C) and not additionally around 700° C. The absence of a crystallization peak D at this temperature indicates a significantly lower percentage of hydrogen bound in the a-Si layer, thus explaining its poorer electrophotographic characteristics.

Figure 2:
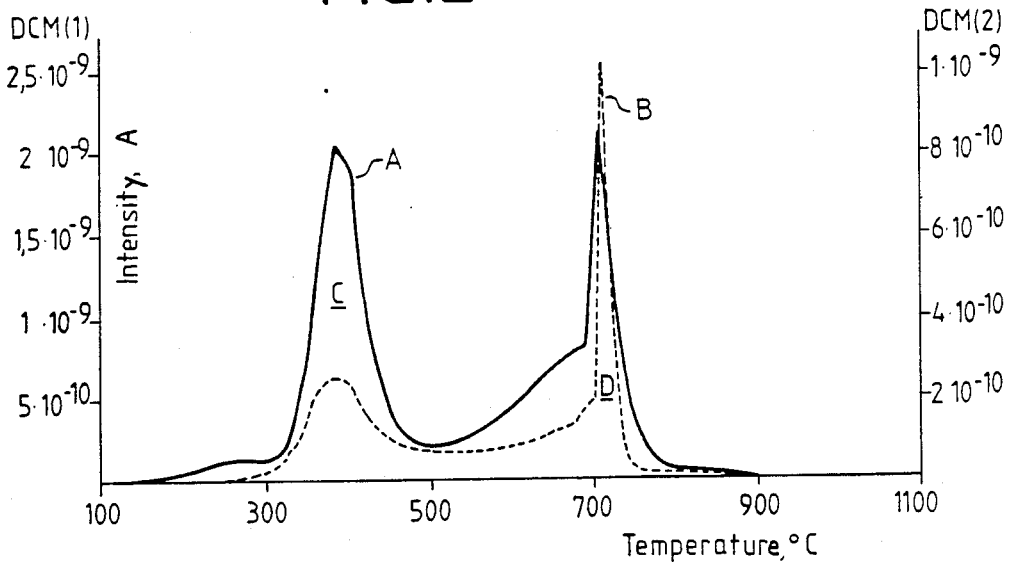
FIG. 2 shows the hydrogen effusion curves of an a-Si layer produced by means of the method according to the invention at a deposition rate of greater than 10 μm/h and of an a-Si layer produced by means of direct current magnetron cathode sputtering and at a significantly lower deposition rate.

In the diagram according to FIG. 2, the hydrogen effusion curve A relates to an a-Si layer produced by the method according to the invention and at a deposition rate greater than 10 μm/h (the shape of curve A corresponds to that of curve A of FIG. 1), while the hydrogen effusion curve B relates to an a-Si layer also grown by means of direct current magnetron cathode sputtering but at a lower deposition rate of about 4 μm/h.

In both cases, there also is a low temperature peak C around 400° C. and a crystallization peak C around 700° C. The shape of curve B indicates that for the a-Si layer produced at the lower deposition rate, the relative heights of peaks C and D are not identical; peak C is noticeably lower than peak D. Thus, the resulting material is less elastic, lower in voids than the material on which curve A is based and there is less unbound hydrogen in the a-Si layer. The electrophotographic characteristics of the a-Si layer produced by means of direct current magnetron sputtering at a deposition rate of about 4 μm/h (curve B) are clearly worse than those of the a-Si layer produced at the higher deposition rate (>10 μm/h).

Figure 3:
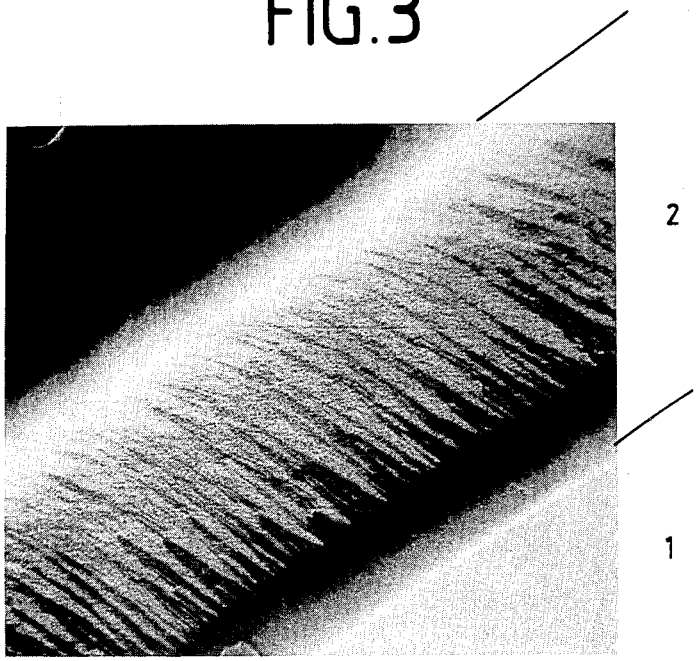
FIG. 3 shows, in a ten thousand times enlargement, the microstructure of a broken edge of an a-Si layer produced by means of high frequency magnetron cathode sputtering.
Figure 4:
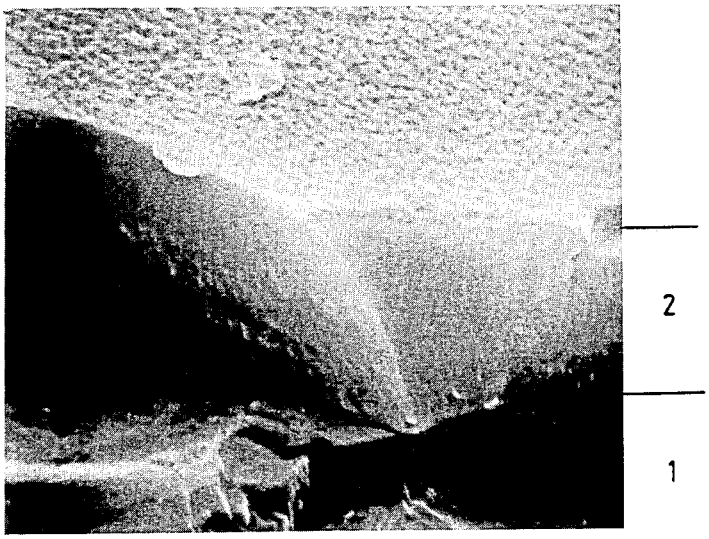
FIG. 4 shows, in a ten thousand times enlargement, the microstructure of a broken edge of an a-Si layer produced according to the method of the invention.

The improvement in the structure of a material produced with the method according to the invention is evident from a comparison of the microstructures shown in FIGS. 3 and 4; in each case, the substrate is marked 1 and the broken edge of the material is marked 2.

The microstructure shown in FIG. 3 is associated with an a-Si layer produced by means of high frequency magnetron cathode sputtering and exhibits a columnar structure with deep troughs which extend far into the layer; these troughs result in great degradation. As can be clearly seen in FIG. 4, the microstructure produced by the method of the present invention is significantly more refined and is highly homogeneous; columns and troughs are no longer in evidence, which in turn results in less degradation of the layer characteristics.

Figure 5:
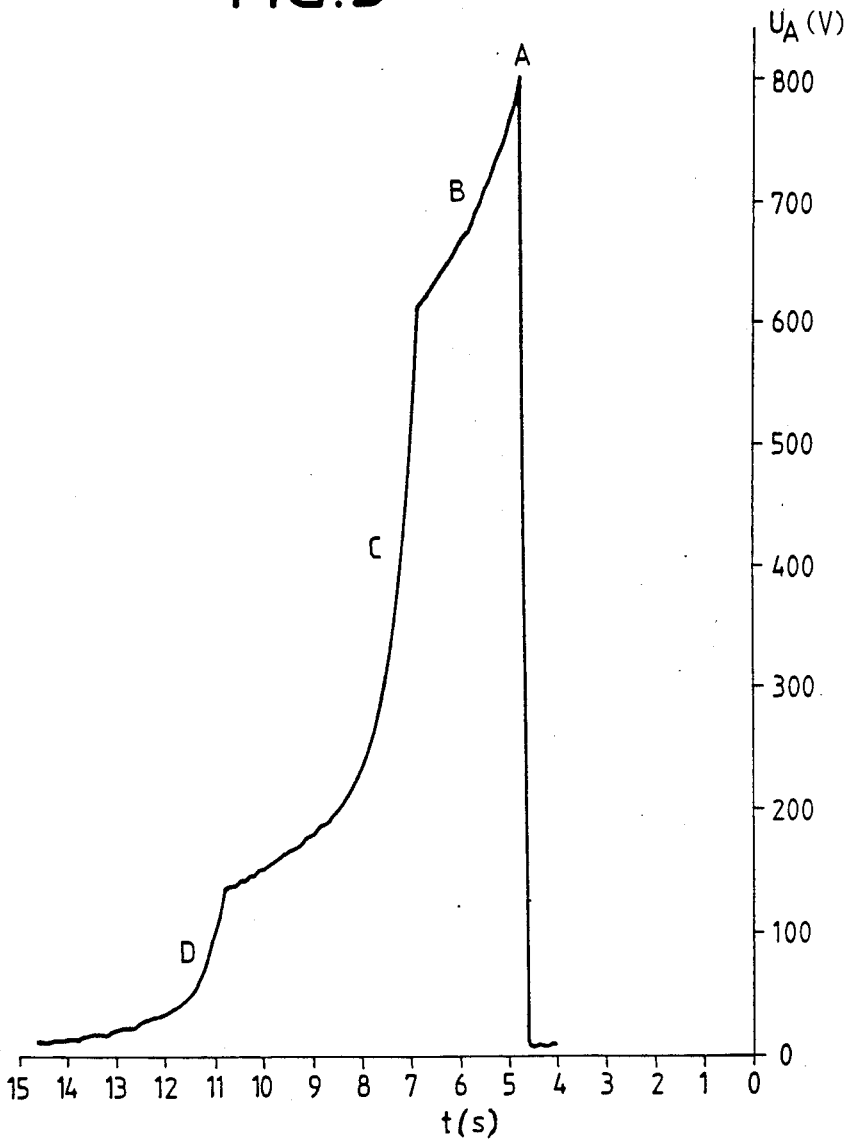
FIG. 5 is a diagram showing the charging potential, the dark discharge and the drop in exposure of an a-Si layer produced according to the method of the invention.

In the diagram of FIG. 5, the charging voltage $U_A$ in volts acting in the a-Si layer is plotted on the ordinate and the time in seconds is plotted on the abscissa.

If the a-Si layer is given a positive charge to a charging potential A of about 800 V, the dark discharge B is 14.5% in 1 second, while the drop in exposure C is 525 V for a measured illumination at a wavelength of 650 nm and an illumination intensity of 5.8 $\mu W/cm^2$. Subsequent illumination D with white light and an illumination intensity of 1 $mW/cm^2$ produces a negligible residual potential of a few volts.

The data for the a-Si layer obtained by means of direct current magnetron sputtering at a relatively high deposition rate indicate that this layer is well suited for electrophotographic use. The power density for the direct current cathode sputtering process is 2.0 $W/cm^2$ to 30 $W/cm^2$, preferably up to 13 $W/cm^2$.

Figure 6:
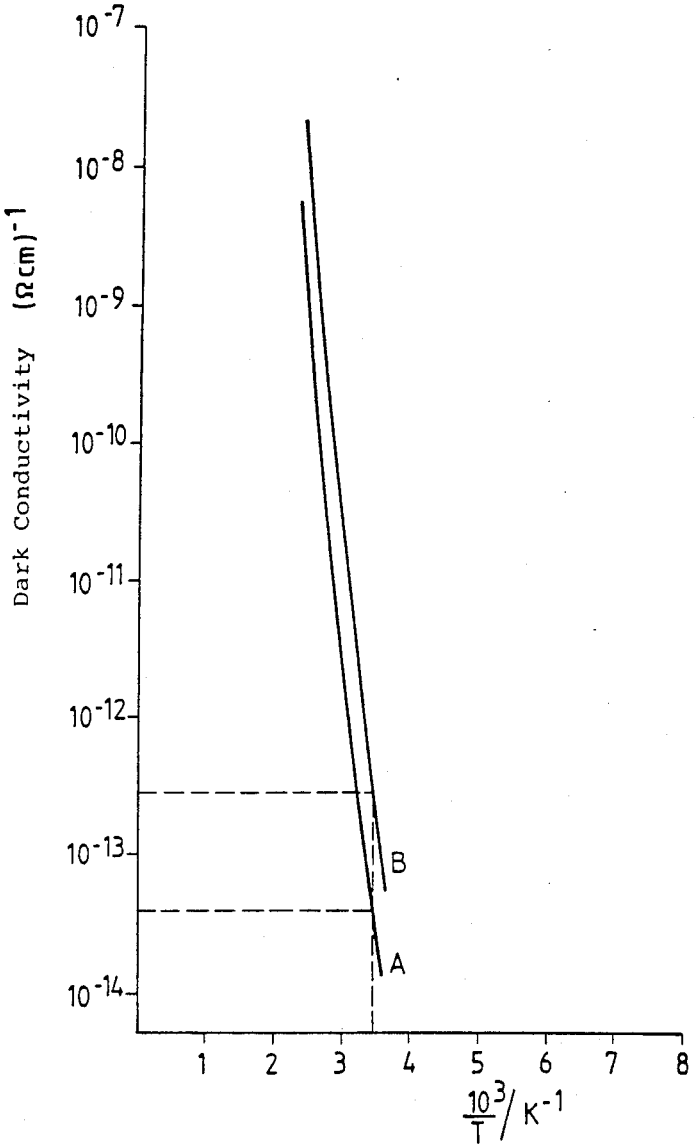
FIG. 6 is a diagram showing the change in dark conductivity of an a-Si layer produced according to the method of the invention as a function of the substrate temperature.

In the diagram of FIG. 6, the dark conductivity of the a-Si layer is plotted logarithmically on the ordinate and the reciprocal temperature is plotted on the abscissa.

As can be seen from curve A, at room temperature and with a hydrogen content of $2\times10^{-3}$ mbar in an argon-hydrogen gas mixture of $5\times10^{-3}$ mbar total pressure, a dark conductivity of $3.5\times10^{-14}\Omega^{-1}cm^{-1}$ results and, according to curve B, with a hydrogen content of $2.6\times10^{-3}$, a dark conductivity of $2.5\times10^{-13}\Omega^{-1}cm^{-1}$ results.

Figure 7:
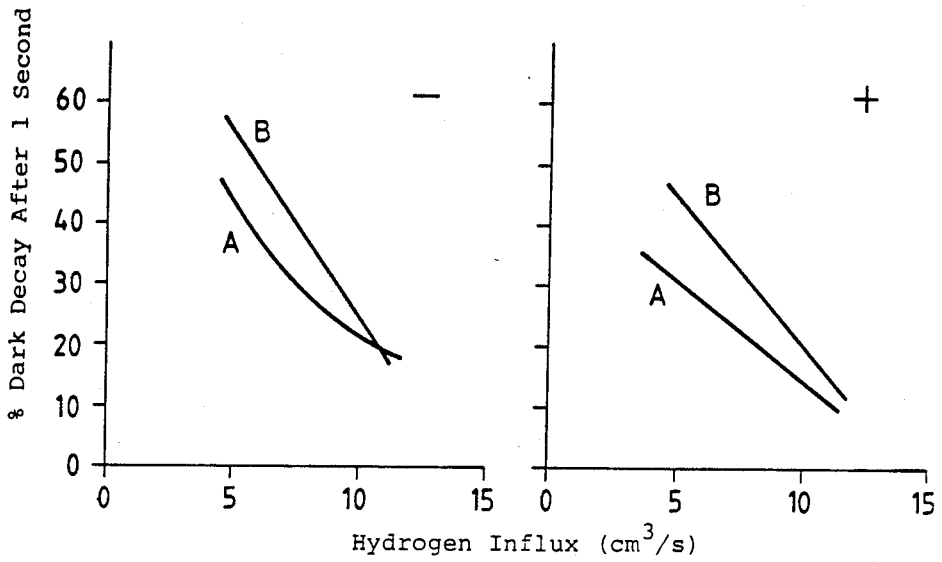
FIG. 7 is a diagram showing the drop in dark decay after 1 second following charging in a structure of Al/-$SiO_x$/a-Si as a function of the influx of hydrogen.

FIG. 7 shows the dark decay in percent after 1 second subsequent to charging the $Al/SiO_x$-aSi structure plotted against the influx of hydrogen regulated by flow meters. The measurement was made for positive and negative charges (indicated in the drawing figure by + and − symbols). Curves A in each case show the values immediately after completion of the structure, curves B reflect measurements taken after 17 to 23 days and document the degradation of the structure. As can be seen, with a larger supply of hydrogen in the gas mixture, the dark decay value decreases; this can be explained by the greater hydrogen content in the a-Si layer. The dark decay reaches values up to 10%. The degradation is less for positive as well as negative charges if the hydrogen supply in the gas mixture is greater.

Figure 8:
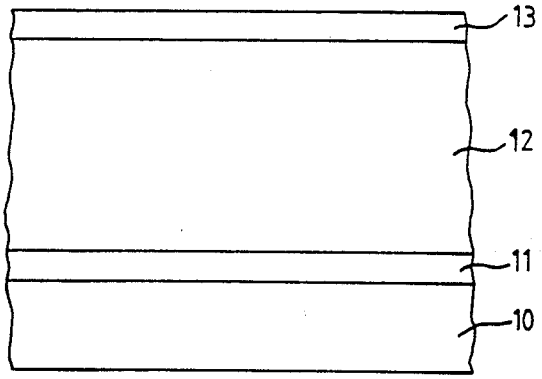
FIG. 8 is a cross-sectional representation of an electrophotographic recording material.

Referring to FIG. 8, a recording material produced according to the above-described method is composed of an aluminum substrate 10 and a blocking layer 11 which supports an amorphous silicon layer 12 on which there is disposed a cover layer 13. This silicon layer contains an inert gas at 0.01 to 10 atom %, preferably argon in a range from 0.01 to 0.1 atom %. Moreover, the hydrogen content is more than 40 atom %. The relative peak heights of the low and high temperature peaks during hydrogen effusion are approximately the same.

The blocking layer is preferably composed of $SiO_x$ or $SiC_x$ or of amorphous carbon (a-C:H) or doped, amorphous silicon. The cover layer is preferably composed of $SiO_x$ or $SiC_x$ or amorphous carbon or $SiN_x$. The recording material is preferably employed for electrophotographic purposes.

The present disclosure relates to the subject matter disclosed in Federal Republic of Germany Application No. P 37 17 727.3 on May 26th, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method of producing an electrophotographic recording material, comprising:

a first step of coating an aluminum substrate with a blocking layer which is a member of the group consisting of $SiO_x$, $SiC_x$, amorphous carbon and doped, amorphous silicon;

a second step of coating said blocking layer with a layer of amorphous silicon by direct current magnetron cathode sputtering using at least one sputter target containing silicon, wherein a power density of from about 2.0 $W/cm^2$ to about 30 $W/cm^2$ is used for said sputtering, and wherein said second step is performed in an atmosphere containing hydrogen and at least one inert gas, wherein the total pressure of inert gas and hydrogen lies in a range from about $1\times10^{-3}$ to about $10\times10^{-3}$ mbar; and a third step of coating said amorphous silicon layer with a cover layer.

2. A method as defined in claim 1, wherein said atmosphere has a hydrogen content in a range from about 30 to about 60%.

3. A method as defined in claim 1, wherein the substrate temperature is in a range between 20° C. and 300° C.

4. A method as defined in claim 1, wherein at least one sputter target is composed of one of p-conductive and n-conductive crystalline silicon having a resistance lower than or equal to 10 Ω cm.

5. A method as defined in claim 1, wherein the power density for direct current cathode sputtering is in a range from about 2.0 $W/cm^2$ to about 13 $W/cm^2$.

6. A method as defined in claim 1, wherein the inert gas is argon and the argon content in the amorphous silicon is in a range from 0.01 to 0.1 atom %.

7. An electrophotographic recording material, disposed on an aluminum substrate, comprising: a blocking layer, disposed on the aluminum substrate; an amorphous silicon layer disposed on said blocking layer, said amorphous silicon layer containing argon at 0.01 to 10 atom %, hydrogen at more than 40 atom %, and relative peak heights of low and high temperature peaks during hydrogen effusion which are approximately equal; and a cover layer disposed on said silicon layer.

8. A recording material as defined in claim 5, wherein the amorphous silicon contains at least one of oxygen and carbon in a range from 0 to 10 atom %.

9. A recording material as defined in claim 7, wherein the blocking layer is composed of one from the group consisting of $SiO_x$, $SiC_x$, amorphous carbon and doped, amorphous silicon.

10. A recording material as defined in claim 7, wherein the cover layer is composed of one from the group consisting of $SiO_x$, $SiC_x$, amorphous carbon and $SiN_x$.

11. A recording material as defined in claim 7, wherein the amorphous silicon layer is thicker than 10 μm.

12. An electrophotographic recording material, which is deposited on a substrate by means of direct current magnetron sputtering, comprising:

a blocking layer, disposed on the substrate;

an amorphous silicon layer disposed on the blocking layer which contains more than 40 atom % of hydrogen and 0.01 to 10 atom % of argon; and a cover layer disposed on the amorphous layer.

13. A recording material of claim 12, wherein about half of the hydrogen in the amorphous silicon layer is chemically bound.

14. A recording material of claim 12, wherein about half of the hydrogen fills voids in the amorphous silicon layer.

15. A recording material of claim 12, wherein the amorphous silicon layer has a microstructure which is substantially free of columnar growth.

16. The method of claim 1, wherein the coating of the blocking layer with amorphous silicon is at a deposition rate of greater than 10 μm/h.

17. In a method for the production of an electrophotographic recording material by depositing amorphous silicon on a blocking layer on a substrate by means of direct current magnetron cathode sputtering, the improvement which comprises:

depositing amorphous silicon in a hydrogen- and argon-containing atmosphere at a total hydrogen and argon pressure in the range of $10^{-2}$ to $10^{-3}$ mbar and an effective density of 2 to 30 $W/cm^2$.

* * * * *